US005272784A

United States Patent [19]

Levin

[11] Patent Number: 5,272,784

[45] Date of Patent: Dec. 28, 1993

[54] TOOTHBRUSH HANDLE

[76] Inventor: Samuel N. Levin, 10818 Shawnbrook, Houston, Tex. 77071

[21] Appl. No.: 743,803

[22] Filed: Aug. 12, 1991

[51] Int. Cl.[5] ..... A46B 5/00

[52] U.S. Cl. ..... 15/167.1; 15/143.1; D4/104

[58] Field of Search ..... 15/143 R, 167.1, 167.2; D4/104–113, 138

[56] References Cited

U.S. PATENT DOCUMENTS

| | | | |
|---|---|---|---|
| 1,739,324 | 12/1929 | Neissl | 15/167.1 |
| 2,273,207 | 2/1942 | Kuhn | 15/167.1 |
| 2,532,780 | 12/1950 | Pettengill | 15/143 R |
| 4,654,921 | 4/1987 | Dinner | 15/167.1 |

FOREIGN PATENT DOCUMENTS

| | | | |
|---|---|---|---|
| 813148 | 9/1951 | Fed. Rep. of Germany | 15/167.1 |
| 3409 | 2/1979 | Japan | 15/143 R |
| 16886 | 12/1906 | Norway | 15/143 R |
| 8910076 | 11/1989 | PCT Int'l Appl. | 15/167.1 |
| 155730 | 9/1932 | Switzerland | 15/167.1 |
| 1083369 | 9/1967 | United Kingdom | 15/167.1 |

*Primary Examiner*—Harvey C. Hornsby
*Assistant Examiner*—Mark Spisich
*Attorney, Agent, or Firm*—Gunn & Kuffner

[57] ABSTRACT

A toothbrush particular adapted for use in prisons and jails is set forth. The handle is of plastic construction and is preferably formed with a pair of elongate frame members defining preferably two or three cutouts therebetween. The body of the handle is formed of a flexible plastic material and has substantial filler therein. This defines a handle which cannot be sharpened to form a dangerous instrument. The handle is of conventional length and width in other regards.

11 Claims, 1 Drawing Sheet

TOOTHBRUSH HANDLE

BACKGROUND OF THE DISCLOSURE

The present disclosure is directed to an improved toothbrush handle, and more particularly to a toothbrush handle which is of substantial length and size to enable it to be grasped in the hand of a user, and to otherwise enable use of the toothbrush in the ordinary and intended fashion. It is, however, constructed in a special way that deals with a particular problem as will be described.

Toothbrushes are ordinarily formed of plastic and are formed with a plastic handle of substantial length and cross-sectional area. A very popular brand uses a handle of approximately five inches in length. The handle is typically more narrow at the distal end, having a width of perhaps 0.25 or 0.3 inches. The thickness typically is in the range of about 0.2 inches. However, the handle is somewhat wider near the head and can be as wide as 0.5 inches for a common and popular brand. Ordinarily, they are formed of plastic, typical plastics being polyethylene or polypropylene. They are typically solid. It has been regrettably discovered that such toothbrush handles will accept sharpening by abrading the handle which then can be converted into relatively sharply pointed dangerous instruments. This therefore creates a security problem in prisons.

The toothbrush can be sharpened by abrading the lower portion of the handle, stroking in a particular direction and thereby converting the toothbrush into a sharp pointed instrument. Indeed, they have been sharpened and converted into dangerous instruments resulting in fatal stab wounds. The present disclosure sets forth a toothbrush which provides the same dental service in that it includes the customary head with bristles and is supported on a handle of approximately the same length, sufficient to enable proper and ordinary dental hygiene. Nevertheless, the toothbrush of the present disclosure sets forth a structure which will not accept the sharpening and which therefore provides an improved handle. The handle thus supports the head with bristles and additionally enables use in the customary and traditional fashion yet does this with a structure which will not permit sharpening of the handle.

The improved toothbrush of this disclosure is therefore summarized as a toothbrush having a head supporting the conventional tufts of bristles on the head and has a handle attached to the head. The handle is of substantial length enabling the toothbrush to be held in the hand of practically every user, whether large or small, and also has sufficient strength to enable the toothbrush to be used in the ordinary fashion. The handle, however, will not accept sharpening because it is constructed of a relatively soft plastic such as polypropylene, and is constructed with significant open cutouts in the length of the handle. The handle is made of two or more parallel frame members which are cross connected at spaced locations. The handle is made with multiple open space cutouts. Moreover, it is made of a somewhat softer plastic material which has filler material in it. The filler material, an inert material, reduces the ability of the handle to be abraded and sharpened to a sharp point. Moreover, the construction of the handle will not permit sharpening to such a point in light of the fact that the handle has lengthwise cutouts which reduce the ability of the handle to be sharpened and form a deadly instrument.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
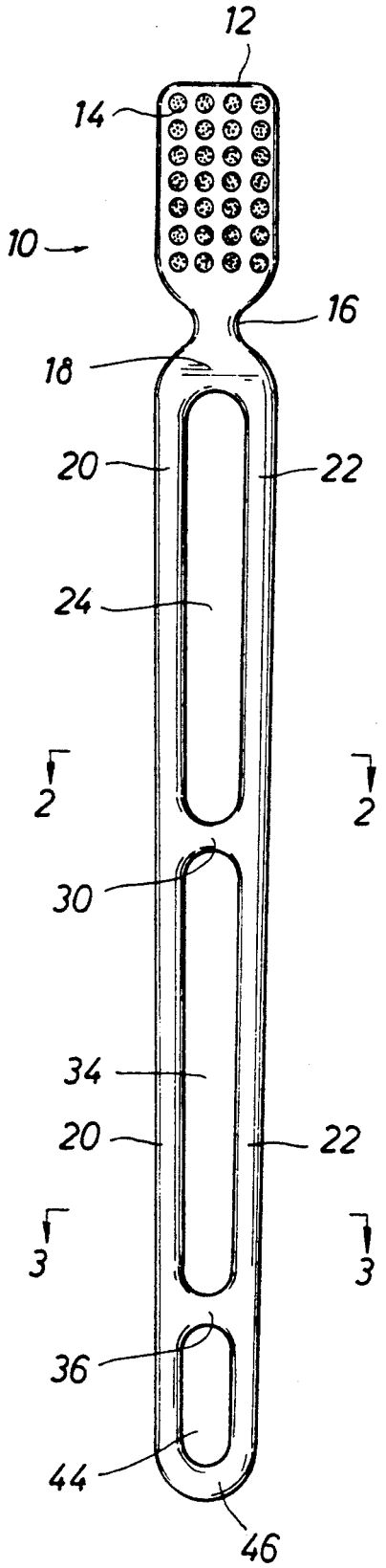
FIG. 1 of the drawings is a plan view of a toothbrush of the present disclosure provided with a handle having a lengthwise frame members with open cutouts therebetween, and further showing how the handle supports the head of the toothbrush for use in the ordinary fashion.

Attention is now directed to FIG. 1 of the drawings where the numeral 10 identifies the improved toothbrush of the present disclosure. The handle 10 is integrally constructed of one piece and is typically formed by injection molding in a mold constructed to provide this size and shape toothbrush. It has a head 12 which is perforated with a set of perforations at 14. Typically, there are about forty perforations in the head and, in the preferred form, they are deployed in a rectangular regular pattern of four holes across and ten along the length of the head. The head has a length of between 25 and 30 mm and has a width of about 10 to 12 mm and is about 6 mm thick. Typically, the tufts support nylon bristles which are about 10–12 mm in length. Typically, 20 to 30 bristles are included in each tuft, and the bristles have a nominal diameter of about 0.25 mm. This forms the head of the toothbrush and is used in dental hygiene in the ordinary fashion.

Figure 2:
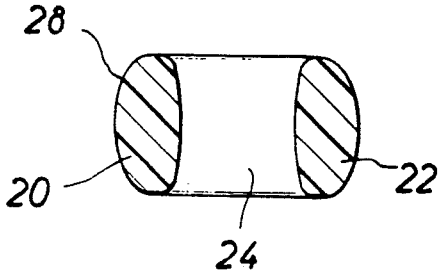
FIG. 2 is a sectional view along the line 2—2 of FIG. 1 of the drawings showing details of construction of the frame members making up the handle.

The present disclosure utilizes the handle portion which is integrally constructed with the head. The handle has a length of about 150 to 175 mm. The handle has a width of about 10 to 13 mm and the material is approximately the same in thickness as the head or, in the preferred form, in the range of about 5 to 7 mm. The handle is formed of polypropylene or polyethylene with filler as will be noted below. The handle in the present disclosure has a somewhat more narrow neck at 16 and then widens to a shoulder portion in the region at 18. It immediately defines left and right frame members 20 and 22. The frame members 20 and 22 define a lengthwise open cutouts 24. The open space cutout 24 is perhaps one third of the width of the handle. If the width of the handle is approximately 10 to perhaps 13 mm wide, the open space cutout 24 has a width of about 4 mm. The length of the cutout is variable, but it is preferably in the range of about 25 to 40 mm. The preferred cutout is about 35 to 40 mm. This defines the two frame member 20 and 22 defining the sides of the cutout, and they are also shown in greater detail in FIG. 2 of the drawings. As shown, the two frame members are not necessarily round or oval; they have an external surface which is curving at 28, and this surface curves so that there is a relatively streamlined exterior shape enabling the device to fit in the hand of the user. Moreover, the two frame members are shown to be identical in size and symmetrical with respect to one another. It is not essential that they be identical; it is, however, desirable that they be relatively narrow, and the narrow dimension is preferably in the range of about 3 or 4 mm. This avoids construction of the handle with a solid member which has a width of perhaps 10 or 12 mm. Such a full bodied handle portion more readily accepts sharpening to form a deadly instrument. Also, the handle construction includes areas where the body is omitted for example, at the several cutouts. Alternate forms of handle construction can use hollow or void areas to reduce body or bulk in the handle.

Figure 3:
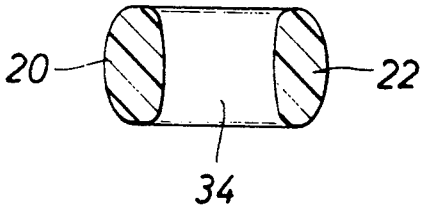
FIG. 3 is a sectional view along the line 3—3 of FIG. 2 showing additional details of the handle construction.

The handle of the present disclosure includes a transverse rib 30 which provides some additional strength and reinforcing. It is immediately adjacent to another cutout 34 which is similar to the cutout at 24. The two cutouts have approximately the same width and length. The handle also extends towards the remote end and has another reinforcing transverse rib 36, and a short cutout 44 which is at the lower end of the handle. This portion of the handle terminates in a loop 46. As shown in FIG. 1, the handle has a slight taper in the preferred form, but this taper is not essential to its construction. The sectional view at FIG. 3 shows that the two frame members 20 and 22 are slightly closer and are slightly smaller although the handle can be approximately uniform along it length in cross-sectional area through the frame members if desired.

The present apparatus is formed of relatively inexpensive plastics, the most common being polyethylene, and the second most common probably being polypropylene. Use of these or other long chain polymers is quite acceptable. As will be understood, and in mentioning polyethylene in particular, it can be formed with long chain polymers which are provided with a wide range of degrees of hardness. It is preferable to use a plastic which is relatively soft and which is additionally provided with a substantial portion of filler material. The filler material is ordinarily an inert granular material of small particles which are mixed in the plastic prior to molding. The percent of filler material that is included changes the nature of the finished product. For one thing, fillers reduce the cost of the plastic in view of the fact that the filler material is ordinarily less costly than polyethylene or polypropylene. Accordingly, suitable filler materials include any kind of granulated particulate material that is substantially inert when mixed in or molded with the plastic material that makes up the handle. In one example, talc can be used. Another exemplary filler material is waste plastic materials that have been ground and randomly distributed in the plastic stock used to make the handle 10 of the present disclosure. One example of this is fabrication scraps which are ground to a size sufficient to enable distribution. They are distributed in the plastic stock prior to molding and can typically constitute anywhere from 2% to 25% of the material. The desired maximum filler mixture in the range of 10% up to 20% is acceptable. In light of the random orientation of the random sized particles in the filler material, strength is limited, and yet sufficient structural integrity is still provided to thereby enable the toothbrush to be used in the ordinary fashion indefinitely without apprehension of failure. In general, the most acceptable mode of fabrications by injection molding.

The finished product of the present invention is a handle integrally constructed with the toothbrush which is particularly able to be used in the ordinary fashion and yet which will not accept sharpening. The frame members 20 and 22 are too thin to accept sharpening to form a dangerous instrument. Even assuming extremely precise sharpening, the two thin frame members are simply too thin and too flimsy to form a sharp knife-like instrument. Rather, if they were sharpened, forming something like a fork having two tines, they are simply too flimsy to be dangerous. If forming a sharp point at the tip 46 is attempted, there is simply not enough material there to accept sharpening to form a dangerous point. The possibility of a puncture wound from this construction is slim. If sharpening occurs at the transverse rib 36, again, there is simply not enough structure there to enable sharpening to a dangerous pointed instrument. If it were sharpened at the transverse rib 30, it would then provide as before an instrument which is not significantly dangerous. Moreover, sharpening at this point would form an instrument that is so short that it could not really function as a knife for inflicting dangerous stab wounds. The construction of the toothbrush handle as shown above and as described in this particular disclosure is an instrument which is therefore able to be issued in jails and penitentiaries, thereby enabling proper dental hygiene to be provided and yet provides a toothbrush which will not be sharpened into a dangerous instrument.

This disclosure thus contemplates a multiple frame member construction in the handle with two or more frame members. Actually, it could be constructed with three frame members or even four, but there is no particular gain in reducing the number below two. When the frame members reach the size set forth in the present disclosure, then the frame members are significantly flimsy and the incorporation of a greater number of frame members carries this construction further to the point that the handle simply will not form a dangerous instrument no matter how carefully it is sharpened as a weapon.

In summary, the apparatus provides a conventional construction handle insofar as dental hygiene is concerned and yet it is modified in accordance with the teachings of this disclosure so that the handle does not become a dangerous instrument.

While the foregoing sets forth the preferred construction, the scope thereof is determined by the claims which follow.

I claim:

1. A toothbrush intended for use in dental hygiene which comprises a head supporting bristles thereon for tooth brushing wherein the head is fixedly connected to a handle sized to fit in the hand of a user, and wherein the handle is formed of a single member comprising two or more elongate frame members joined together and defining therebetween a cutout region in the handle and wherein the handle is of sufficient strength to enable use in dental hygiene.

2. The toothbrush of claim 1 wherein the handle has at least two cutout portions along the length thereof and two spaced frame members extend to the lower end thereof and are joined.

3. The toothbrush of claim 1 wherein said handle frame members are parallel and spaced apart and extend to an end defining transverse connected means between said frame members.

4. The toothbrush of claim 1 including at least a pair of open space cutout regions in said handle between said frame members.

5. The toothbrush of claim 4 wherein said frame members of the handle are symmetrical and adjacent to said cutout region.

6. A toothbrush handle comprising an elongate handle portion sized to fit in the hand of a user and fixedly supporting an integrally constructed head wherein the handle has sufficient width and thickness to enable gripping by the user with sufficient strength to enable dental hygiene with the toothbrush, and wherein the handle is formed of a case member integrally joined to said head and said handle includes multiple openings therein so that the handle will not permit sharpening to thereby form a sharp instrument.

7. The toothbrush of claim 6 wherein said handle comprises a pair of co-extensive frame members defining an open space therebetween.

8. The toothbrush of claim 6 wherein the handle has at least two cutout portions along the length thereof and two spaced frame members extend to the lower end thereof and are joined.

9. The toothbrush of claim 6 wherein said handle is formed of plural, elongate frame members which members are parallel and spaced apart and extend to an end defining transverse connected means between said frame members.

10. The toothbrush of claim 6 including at least a pair of open space cutout regions in said handle between at least a pair of frame members defining said handle.

11. The toothbrush of claim 10 wherein said frame members of the handle are symmetrical and adjacent to said cutout region.

* * * * *